US007789170B2

(12) United States Patent
Church

(10) Patent No.: US 7,789,170 B2
(45) Date of Patent: Sep. 7, 2010

(54) SIDEWALL CORING TOOL AND METHOD FOR MARKING A SIDEWALL CORE

(75) Inventor: Nathan Church, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 304 days.

(21) Appl. No.: 11/946,124

(22) Filed: Nov. 28, 2007

(65) Prior Publication Data

US 2009/0133932 A1 May 28, 2009

(51) Int. Cl.
*E21B 25/16* (2006.01)

(52) U.S. Cl. ..... 175/44; 175/20

(58) Field of Classification Search ..... 175/20, 175/26, 44, 56, 58, 78
See application file for complete search history.

(56) References Cited

U.S. PATENT DOCUMENTS

| | | | | |
|---|---|---|---|---|
| 1,793,894 | A | 2/1931 | Baker | |
| 2,003,345 | A | 6/1935 | De Maris | |
| 2,197,062 | A | 4/1940 | Sweet et al. | |
| 3,032,127 | A | 5/1962 | Kenney et al. | |
| 4,280,569 | A * | 7/1981 | Mount, II | 175/26 |
| 4,714,119 | A | 12/1987 | Hebert et al. | |
| 4,860,581 | A | 8/1989 | Zimmerman et al. | |
| 4,936,139 | A | 6/1990 | Zimmerman et al. | |
| 5,105,894 | A | 4/1992 | Enderlin | |
| 5,310,013 | A * | 5/1994 | Kishino et al. | 175/44 |
| 5,411,106 | A * | 5/1995 | Maissa et al. | 175/78 |
| 5,667,025 | A | 9/1997 | Haessly et al. | |
| 6,006,844 | A | 12/1999 | Van Puymbroeck et al. | |
| 6,371,221 | B1 | 4/2002 | Harrigan et al. | |
| 6,729,416 | B2 * | 5/2004 | Contreras et al. | 175/20 |
| 7,191,831 | B2 | 3/2007 | Reid et al. | |
| 2009/0114447 | A1 * | 5/2009 | Reid et al. | 175/58 |

* cited by examiner

*Primary Examiner*—Daniel P Stephenson
(74) *Attorney, Agent, or Firm*—Dave R. Hofman

(57) ABSTRACT

A sidewall coring tool includes a tool housing, a coring assembly coupled and a marking device. The defines a longitudinal axis and is adapted for suspension within the borehole at a selected depth. The coring assembly is coupled to the tool housing and includes a bit housing and a coring bit coupled to the bit housing. The coring bit is supported for movement between a transport position and a coring position. The marking device is located at a known position with respect to the coring bit and is adapted to form an orientation mark in the formation.

15 Claims, 9 Drawing Sheets

SIDEWALL CORING TOOL AND METHOD FOR MARKING A SIDEWALL CORE

BACKGROUND

1. Technical Field

This disclosure generally relates to oil and gas well drilling and the subsequent investigation of subterranean formations surrounding the well. More particularly, this disclosure relates to apparatus and methods for obtaining sidewall cores from a subterranean formation.

2. Description of the Related Art

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

Once a formation of interest is reached, drillers often investigate the formation and its contents through the use of downhole formation evaluation tools. Some types of formation evaluation tools form part of the drill string and are used during the drilling process. These are called, for example, "logging-while-drilling" ("LWD") tools or "measurement-while-drilling" ("MWD") tools. MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms. Furthermore, LWD and MWD are not necessarily performed while the drill bit is actually cutting through the formation. For example, LWD and MWD may occur during interruptions in the drilling process, such as when the drill bit is briefly stopped to take measurements, after which drilling resumes. Measurements taken during intermittent breaks in drilling are still considered to be made "while-drilling" because they do not require the drill string to be removed from the wellbore, or "tripped."

Other formation evaluation tools are used sometime after the well has been drilled. Typically, these tools are lowered into a well using a wireline for electronic communication and power transmission, and therefore are commonly referred to as "wireline" tools. In general, a wireline tool is lowered into a well so that it can measure formation properties at desired depths.

One type of wireline tool is called a "formation testing tool." The term "formation testing tool" is used to describe a formation evaluation tool that is able to draw fluid from the formation into the downhole tool. In practice, a formation testing tool may involve many formation evaluation functions, such as the ability to take measurements (i.e., fluid pressure and temperature), process data and/or take and store samples of the formation fluid. Thus, in this disclosure, the term formation testing tool encompasses a downhole tool that draws fluid from a formation into the downhole tool for evaluation, whether or not the tool stores samples. Examples of formation testing tools are shown and described in U.S. Pat. Nos. 4,860,581 and 4,936,139, both assigned to the assignee of the present application.

During formation testing operations, downhole fluid is typically drawn into the downhole tool and measured, analyzed, captured and/or released. In cases where fluid (usually formation fluid) is captured, sometimes referred to as "fluid sampling," fluid is typically drawn into a sample chamber and transported to the surface for further analysis (often at a laboratory). As fluid is drawn into the tool, various measurements of downhole fluids are typically performed to determine formation properties and conditions, such as the fluid pressure in the formation, the permeability of the formation and the bubble point of the formation fluid. The permeability refers to the flow potential of the formation. A high permeability corresponds to a low resistance to fluid flow. The bubble point refers to the fluid pressure at which dissolved gasses will bubble out of the formation fluid. These and other properties may be important in making downhole decisions.

Another downhole tool typically deployed into a wellbore via a wireline is called a "coring tool." Unlike the formation testing tools, which are used primarily to collect sample fluids, a coring tool is used to obtain a sample of the formation rock.

A typical coring tool includes a hollow drill bit, called a "coring bit," that is advanced into the formation wall so that a sample, called a "core sample," may be removed from the formation. A core sample may then be transported to the surface, where it may be analyzed to assess, among other things, the reservoir storage capacity (called porosity) and permeability of the material that makes up the formation; the chemical and mineral composition of the fluids and mineral deposits contained in the pores of the formation; and/or the irreducible water content of the formation material. The information obtained from analysis of a core sample may also be used to make downhole decisions.

Downhole coring operations generally fall into two categories: axial and sidewall coring. "Axial coring," or conventional coring, involves applying an axial force to advance a coring bit into the bottom of the well. Typically, this is done after the drill string has been removed, or "tripped," from the wellbore, and a rotary coring bit with a hollow interior for receiving the core sample is lowered into the well on the end of the drill string. An example of an axial coring tool is depicted in U.S. Pat. No. 6,006,844, assigned to Baker Hughes.

By contrast, in "sidewall coring," the coring bit is extended radially from the downhole tool and advanced through the side wall of a drilled borehole. In sidewall coring, the drill string typically cannot be used to rotate the coring bit, nor can it provide the weight required to drive the bit into the formation. Instead, the coring tool itself must generate both the torque that causes the rotary motion of the coring bit and the axial force, called weight-on-bit ("WOB"), necessary to drive the coring bit into the formation. Another challenge of sidewall coring relates to the dimensional limitations of the borehole. The available space is limited by the diameter of the borehole. There must be enough space to house the devices to operate the coring bit and enough space to withdraw and store a core sample. A typical sidewall core sample is about 1.5 inches (about.3.8 cm) in diameter and less than 3 inches long (.about.7.6 cm), although the sizes may vary with the size of the borehole. Examples of sidewall coring tools are shown and described in U.S. Pat. Nos. 4,714,119 and 5,667,025, both assigned to the assignee of the present application.

During sidewall core analysis, it is advantageous to know the orientation of the core as it resided in the formation prior to its removal. "Orientation" as used herein means which end of the core faced or was exposed to the borehole. Additionally or alternatively, the "orientation" of a core indicates how the core was positioned with respect to the axis of the borehole (i.e., which part of the core was at the least depth or top). Currently, sidewall core orientation can be determined by a close examination of the physical features of the core. This method, however, requires an intimate knowledge of the formation geology as well as the operation of the coring tool. The details of the formation geology are often not known or overly expensive to obtain, and therefore this approach is not feasible in many applications. In some circumstances, "Orientation" could refer to drilling orientation, or the radial direction, relative to the center of the borehole, in which the core was taken. Projected on a horizontal plane, this type of orientation is typically measured in degrees from North. Drilling orientation measurements are already possible with the use of downhole orientation tools.

SUMMARY OF THE DISCLOSURE

In accordance with one aspect of the disclosure, a sidewall coring tool having a tool housing, a coring assembly and a marking device is disclosed. The tool housing defines a longitudinal axis and is adapted for suspension within the borehole at a selected depth. The coring assembly is coupled to the tool housing and includes a bit housing and a coring bit coupled to the bit housing that is supported for movement between a transport position and a coring position. The marking device is located at a known position with respect to the coring bit and is adapted to form an orientation mark in the formation.

In accordance with another aspect of the disclosure, a sidewall coring tool having a tool housing, a coring assembly and an orientation marking device is disclosed. The tool housing defines a longitudinal axis and is adapted for suspension within the borehole at a selected depth. The coring assembly is coupled to the tool housing and includes a bit housing and a coring bit coupled to the bit housing that is supported for movement between a transport position and a coring position. The marking device is supported for reciprocating movement with respect to the tool housing and is operably coupled to the coring assembly motor.

In accordance with another aspect of the disclosure, a sidewall coring tool having a rotation actuator and an extension actuator is disclosed. The sidewall coring tool further includes a tool housing that defines a longitudinal tool axis and is adapted for suspension within the borehole at a selected depth, a coring aperture formed in the tool housing, a core receptacle disposed in the tool housing, a bit housing disposed within the tool housing, a coring bit mounted within the bit housing that includes a cutting end and that defines a coring bit axis. A bit motor is operably coupled to the coring bit and is adapted to rotate the coring bit around the bit axis. The rotation actuator is operably coupled to the bit housing and is adapted to actuate the bit housing between an eject position, in which the coring bit axis is substantially parallel to the tool axis, and a coring position, in which the coring bit axis is substantially perpendicular to the tool axis. The extension actuator is operably coupled to the coring bit and ia adapted to move the coring bit between retracted and extended positions, wherein the extension actuator is operable independent of the rotation actuator to extend the coring bit when the coring bit axis is at an oblique angle, thereby to form an orientation mark in the formation.

In accordance with yet another aspect of the disclosure, a method of marking a core retrieved from a sidewall of a wellbore includes suspending a sidewall coring tool within a borehole at a selected depth, marking a surface of the borehole at a selected location to form an orientation mark, and extending a coring bit into the formation at the selected location to form a sidewall core.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure relates to apparatus and methods for obtaining core samples from subterranean formations. Various embodiments for forming an orientation mark in a sidewall sample are disclosed. In some embodiments, a sidewall coring tool includes a separate marking device to form a mark in the formation prior to coring. In other embodiments, the coring bit itself is used to form the mark. The apparatus and methods disclosed herein may be used in both "wireline" and "while-drilling" applications.

Figure 1:
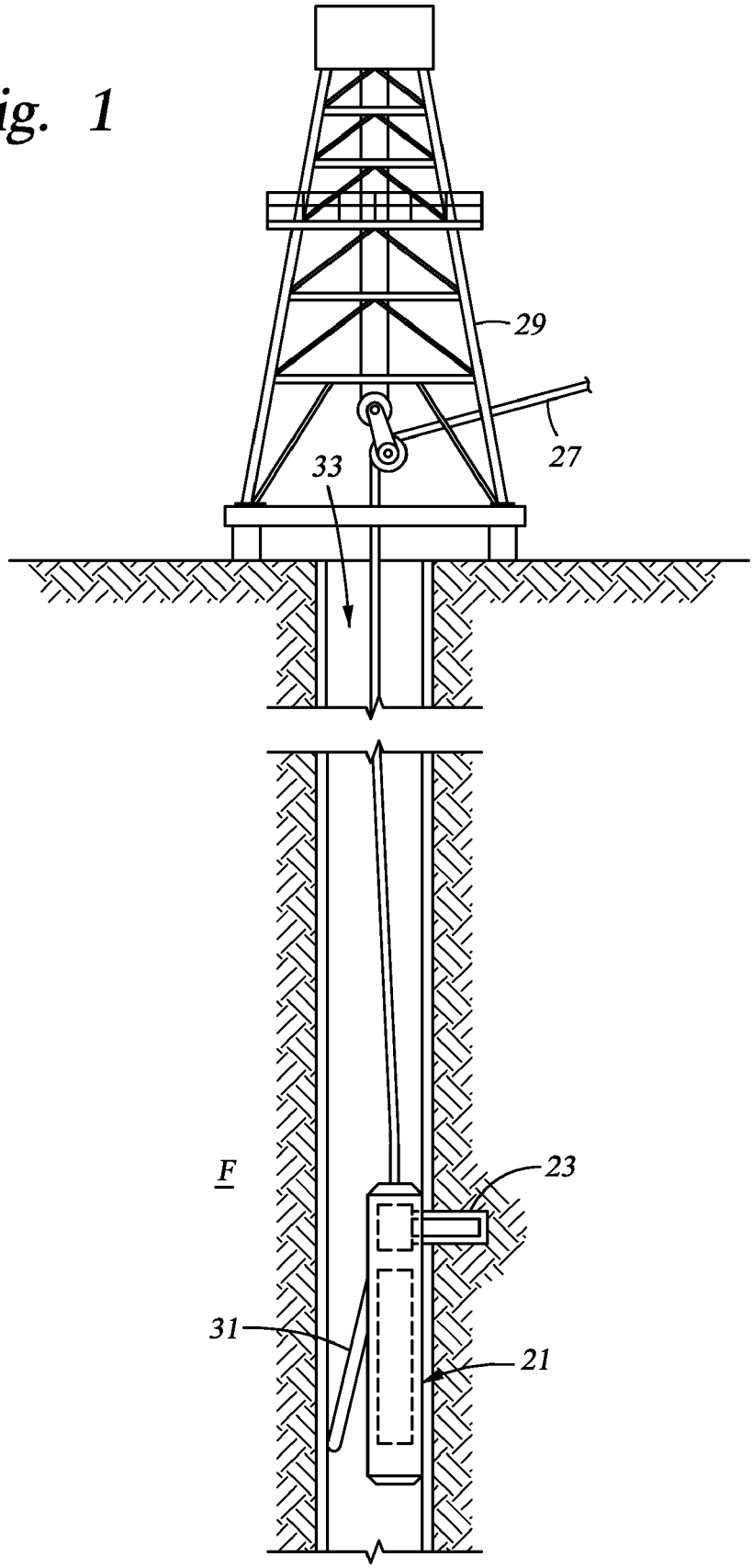
FIG. 1 is a schematic of first embodiment of a sidewall coring tool.

FIG. 1 illustrates an example of a sidewall coring tool 21 suspended in a borehole 33 by a wireline 27 supported by a rig 29. A sample may be taken using a coring bit 23 that is extended from the coring tool 21 into the formation F. The coring tool 21 may be braced in the borehole by a support arm 31. An example of a commercially available coring tool of this type is the Mechanical Sidewall Coring Tool ("MSCT") by Schlumberger Corporation, the assignee of the present disclosure. The MSCT is further described in U.S. Pat. Nos. 4,714,119 and 5,667,025, both assigned to the assignee of the present disclosure.

Figure 2:
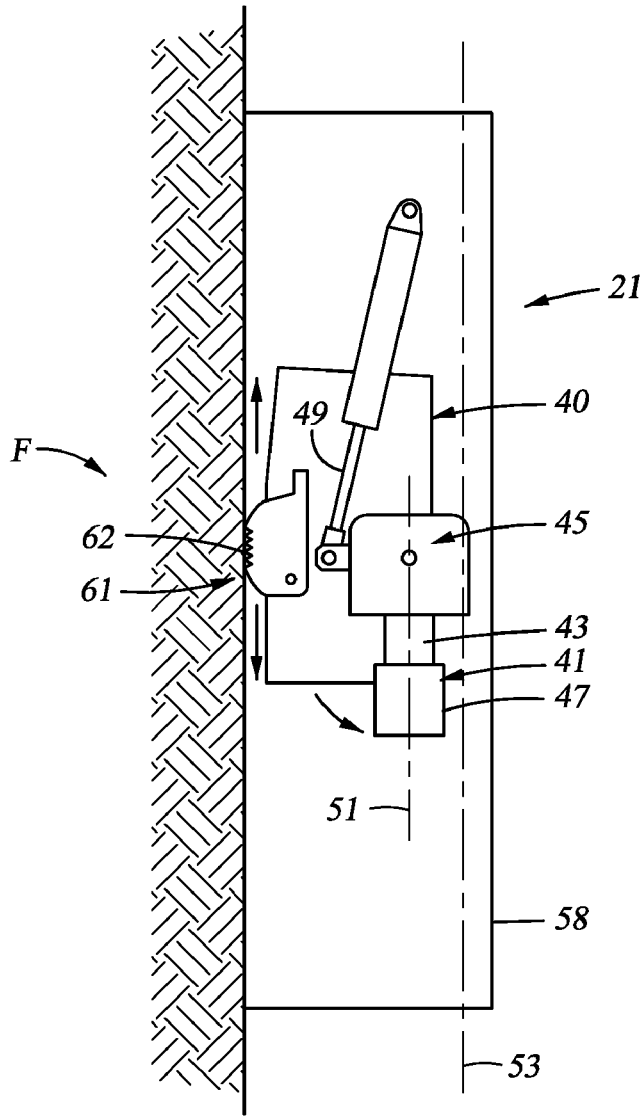
FIG. 2 is an enlarged schematic side elevation view of the sidewall coring tool of FIG. 1.

As best shown in FIG. 2, the sidewall coring tool 21 includes a coring assembly 40 for drilling into the borehole to obtain a sidewall core. The coring assembly 40 includes a coring bit 41 supported for rotation with respect to a housing 38 of the tool 21. The coring bit 41 includes a shaft 43 with a hollow interior. A formation cutting element 47 is located at a cutting end of the shaft 43. Many different types of formation cutting elements for a rotary coring bit are known in the art and may be used without departing from the scope of this disclosure. A motor 45 is operably coupled to the shaft 43 thereby to rotate the shaft 43.

A bit drive is coupled to the coring bit 41 to rotate it between transport and coring positions. In the illustrated embodiment, the bit drive includes a hydraulic arm 49 operably coupled to the coring bit 41. Operation of the hydraulic arm 49 will move the coring bit 41 between a transport position, in which an axis 51 of the coring bit 41 is substantially parallel to an axis 53 of the borehole, to a coring position, in which the coring bit axis 51 is substantially perpendicular to the borehole axis 53. When in the coring position, the coring bit 41 may be extended into the formation as the bit rotates, thereby to form a sidewall core. While a hydraulic drive is illustrated in FIG. 2, it will be appreciated that other types of bit drives may be used without departing from the scope of this disclosure.

Figure 3:
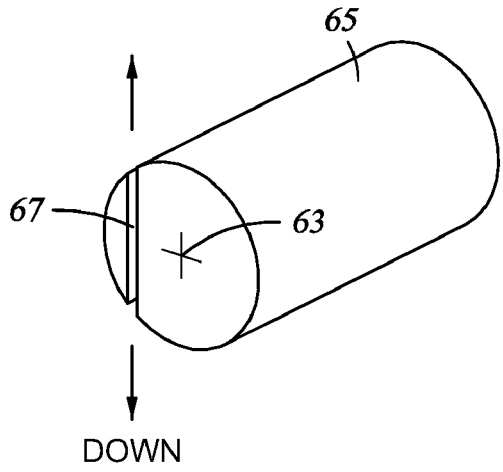
FIG. 3 is an enlarged perspective view of a sidewall core.

The coring tool 21 further includes a marking device for forming an orientation indicating mark in a selected location on a surface of the formation. As shown in FIG. 2, the marking device may be a cutting blade 61 having teeth 62. The cutting blade 61 may be an "active" marking device in that it is operably coupled to the bit drive. In the active marking device embodiments, the bit drive moves the cutting blade 61 so that it engages the formation and moves along the formation surface to form the orientation mark 67 (FIG. 3). The cutting blade 61 may be moved at the same time as the coring bit 41 is rotated from the transport position to the coring position. The cutting blade 61 may execute a uni-directional movement, a reciprocating movement, or any other movement suitable for forming a mark 67 in the formation surface. For relatively hard formations, the coring bit 41 may be rotated back and forth multiple times to repeat the cutting engagement of the blade 61 with the formation surface. The orientation mark 67 may be a linear line, a crescent (as described below), or any other shape suitable for indicating orientation. For linear and other similarly shaped marks, the length of the mark may exceed the diameter of the core to be formed to provide a larger target area for forming the core, as better understood below.

The cutting blade 61 may further be located at a known position with respect to the coring bit 41 so that the coring bit 41 may be repositioned as needed to form the core 65 in the selected location of the formation, thereby ensuring that the resulting sidewall core 65 includes the orientation mark 67. If the orientation mark 67 is substantially linear (as shown in FIG. 3), it is advantageous to form it at a point that is offset from an axis 63 of the sidewall core 65, as shown in FIG. 3, so that the upper and lower portions of the sidewall core 65 may be more readily determined.

In an alternative embodiment, the cutting blade 61 may be coupled to the tool housing to provide a passive cutting device. In this alternative embodiment, the cutting tool simply engages the borehole wall as the tool 21 is positioned for coring. The incidental contact between the cutting blade 61 and the formation surface as the tool 21 is positioned will form an orientation mark in the surface. The cutting blade 61 may again be located at a known position with respect to the coring bit 41 so that the core may be formed in an area that includes the orientation mark.

Figure 4:
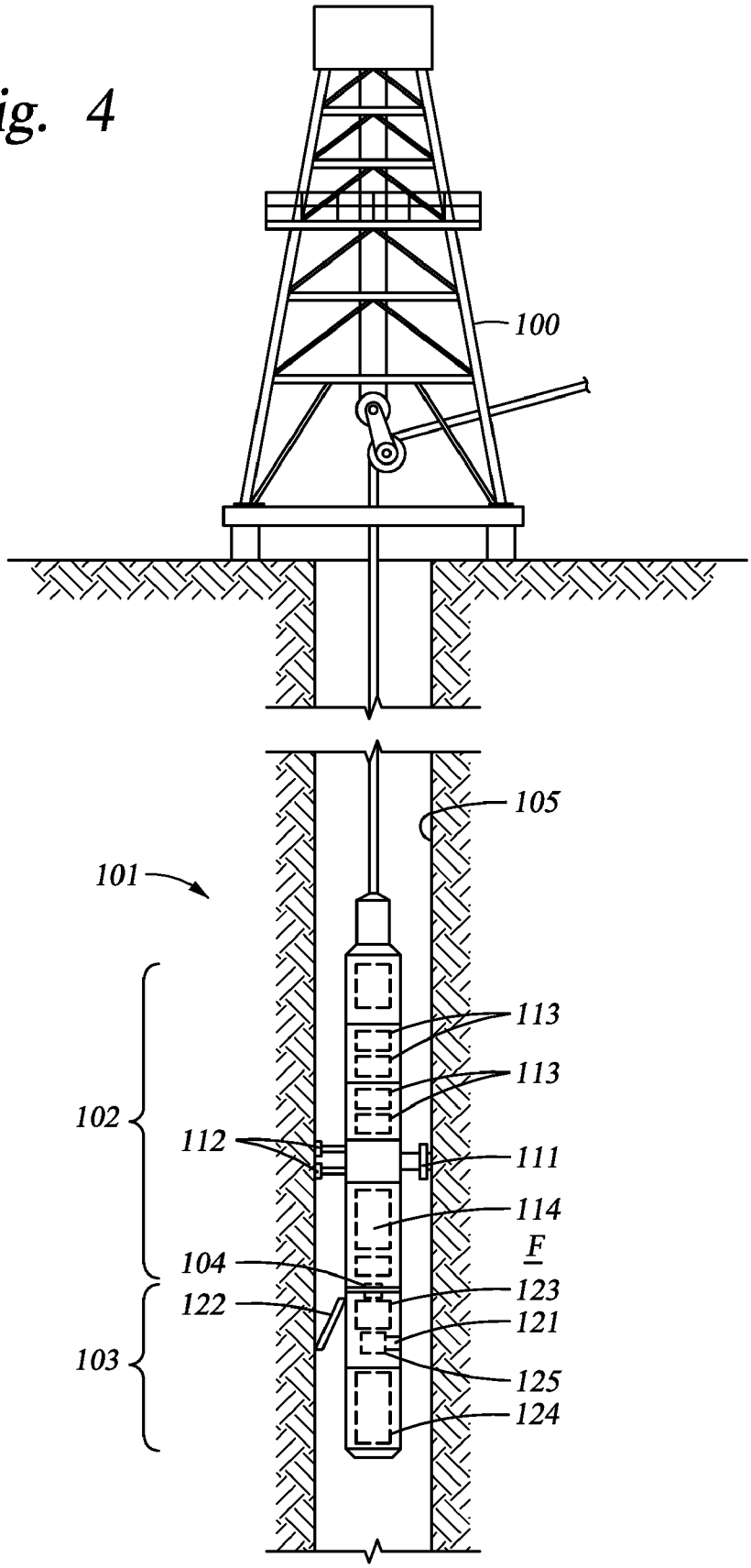
FIG. 4 is a schematic of a wireline assembly that includes a coring tool.

Yet another alternative sidewall coring tool is illustrated in FIG. 4, which shows a schematic illustration of a wireline apparatus 101 deployed into a wellbore 105 from a rig 100. The wireline apparatus 101 includes a coring tool 103. The coring tool 103 is illustrated as having a coring assembly 125 with a coring bit 121, a storage area 124 for storing core samples, and the associated control mechanisms 123. The storage area 124 is configured to receive sample cores, which may or may not include a sleeve, canister, or other holding receptacle. At least one brace arm 122 may be provided to stabilize the tool 101 in the borehole (not shown) when the coring bit 121 is functioning.

The wireline apparatus 101 may further include additional systems for performing other functions. One such additional system is illustrated in FIG. 4 as a formation testing tool 102 that is operatively connected to the coring tool 103 via field joint 104. The formation testing tool 102 may include a probe 111 that is extended from the formation testing tool 102 to be in fluid communication with a formation F. Back up pistons 112 may be included in the tool 101 to assist in pushing the probe 111 into contact with the sidewall of the wellbore and to stabilize the tool 102 in the borehole. The formation testing tool 102 shown in FIG. 4 also includes a pump 114 for pumping the sample fluid through the tool, as well as sample chambers 113 for storing fluid samples. The locations of these components are only schematically shown in FIG. 4, and may be provided in other locations within the tool than as illustrated. Other components may also be included, such as a power module, a hydraulic module, a fluid analyzer module, and other devices.

The apparatus of FIG. 4 is depicted as having multiple modules operatively connected together. The apparatus, however, may also be partially or completely unitary. For example, as shown in FIG. 4, the formation testing tool 102 may be unitary, with the coring tool housed in a separate module operatively connected by field joint 104. Alternatively, the coring tool may be unitarily included within the overall housing of the apparatus 101.

Downhole tools often include several modules (i.e., sections of the tool that perform different functions). Additionally, more than one downhole tool or component may be combined on the same wireline to accomplish multiple downhole tasks in the same wireline run. The modules are typically connected by "field joints," such as the field joint 104 of FIG. 4. For example, one module of a formation testing tool typically has one type of connector at its top end and a second type of connector at its bottom end. The top and bottom connectors are made to operatively mate with each other. By using modules and tools with similar arrangements of connectors, all of the modules and tools may be connected end to end to form the wireline assembly. A field joint may provide an electrical connection, a hydraulic connection, and a flowline connection, depending on the requirements of the tools on the wireline. An electrical connection typically provides both power and communication capabilities.

In practice, a wireline tool will generally include several different components, some of which may be comprised of two or more modules (e.g., a sample module and a pumpout module of a formation testing tool). In this disclosure, "module" is used to describe any of the separate tools or individual tool modules that may be connected in a wireline assembly. "Module" describes any part of the wireline assembly, whether the module is part of a larger tool or a separate tool by itself. It is also noted that the term "wireline tool" is sometimes used in the art to describe the entire wireline assembly, including all of the individual tools that make up the assembly. In this disclosure, the term "wireline assembly" is used to prevent any confusion with the individual tools that make up the wireline assembly (e.g., a coring tool, a formation testing tool, and an NMR tool may all be included in a single wireline assembly).

Figure 5:
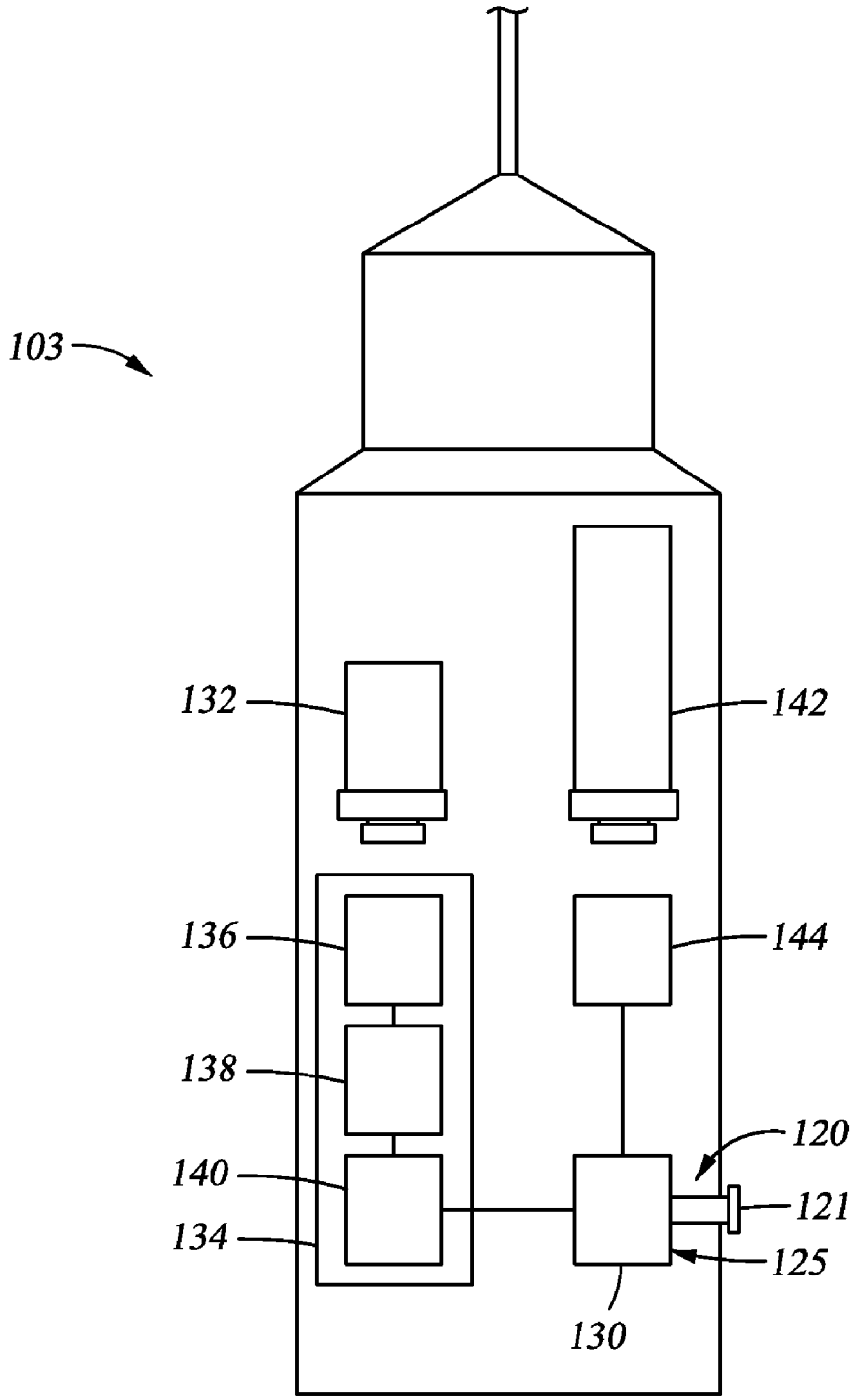
FIG. 5 is an enlarged schematic of the coring tool module of FIG. 1.

FIG. 5 is an enlarged schematic illustration of the coring tool 103. As noted above, the coring tool 103 includes the coring assembly 125 with the coring bit 121. A hydraulic coring motor 130 is operatively coupled to rotationally drive the coring bit 121 so that it may cut into the formation F and obtain a core sample.

In order to drive the coring bit 121 into the formation, it must be pressed into the formation while it is being rotated. Thus, the coring tool 103 applies a weight-on-bit ("WOB") (i.e., the force that presses the coring bit 121 into the formation) and a torque to the coring bit 121. FIG. 5 schematically depicts mechanisms for applying both of these forces. For example, the WOB may be generated by a motor 132, which may be an AC, brushless DC, or other power source, and a control assembly 134. The control assembly 134 may include a hydraulic pump 136, a feedback flow control ("FFC") valve 138, and a piston 140. The motor 132 supplies power to the hydraulic pump 136, while the flow of hydraulic fluid from the pump 136 is regulated by the FFC valve 138. The pressure of the hydraulic fluid drives the piston 140 to apply a WOB to the coring bit 121, as described in greater detail below.

The torque may be supplied by another motor 142, which may be an AC, brushless DC, or other power source, and a gear pump 144. The second motor 142 drives the gear pump 144, which supplies a flow of hydraulic fluid to the hydraulic coring motor 130. The hydraulic coring motor 130, in turn, imparts a torque to the coring bit 121 that causes the coring bit 121 to rotate.

While specific examples of the mechanisms for applying WOB and torque are provided above, any known mechanisms for generating such forces may be used without departing from the scope of this disclosure. Additional examples of mechanisms that may be used to apply WOB and torque are disclosed in U.S. Pat. Nos. 6,371,221 and 7,191,831, both of which are assigned to the assignee of the present application and are incorporated herein by reference.

The coring tool 103 is shown in greater detail in FIGS. 6-9. The coring tool 103 includes a tool housing 150 extending along a longitudinal axis 152. The tool housing 150 defines a coring aperture 154 through which core samples are retrieved. The coring assembly 125 and storage area 124 are disposed within the tool housing 150.

The coring tool 103 and the storage area 124, in particular, may have associated mechanism to separate individual core samples (not shown). One such system uses disks to separate each core. This mechanism is often referred to as a "marking system" and the disks are often described as "core markers."

The coring assembly 125 includes a bit housing 156, which may be rotatably coupled to the tool housing 150. The coring bit 121 is mounted within the bit housing 156 such that it may both slide axially and rotate within the bit housing 156. The coring motor 130 is also mounted on the bit housing 156 and is operably connected to the coring bit 121 to rotate the bit. While the coring motor 130 is illustrated herein as a hydraulic motor, it will be appreciated that any type of motor or mechanism capable of rotating the coring bit 121 may be used.

Figure 10A:
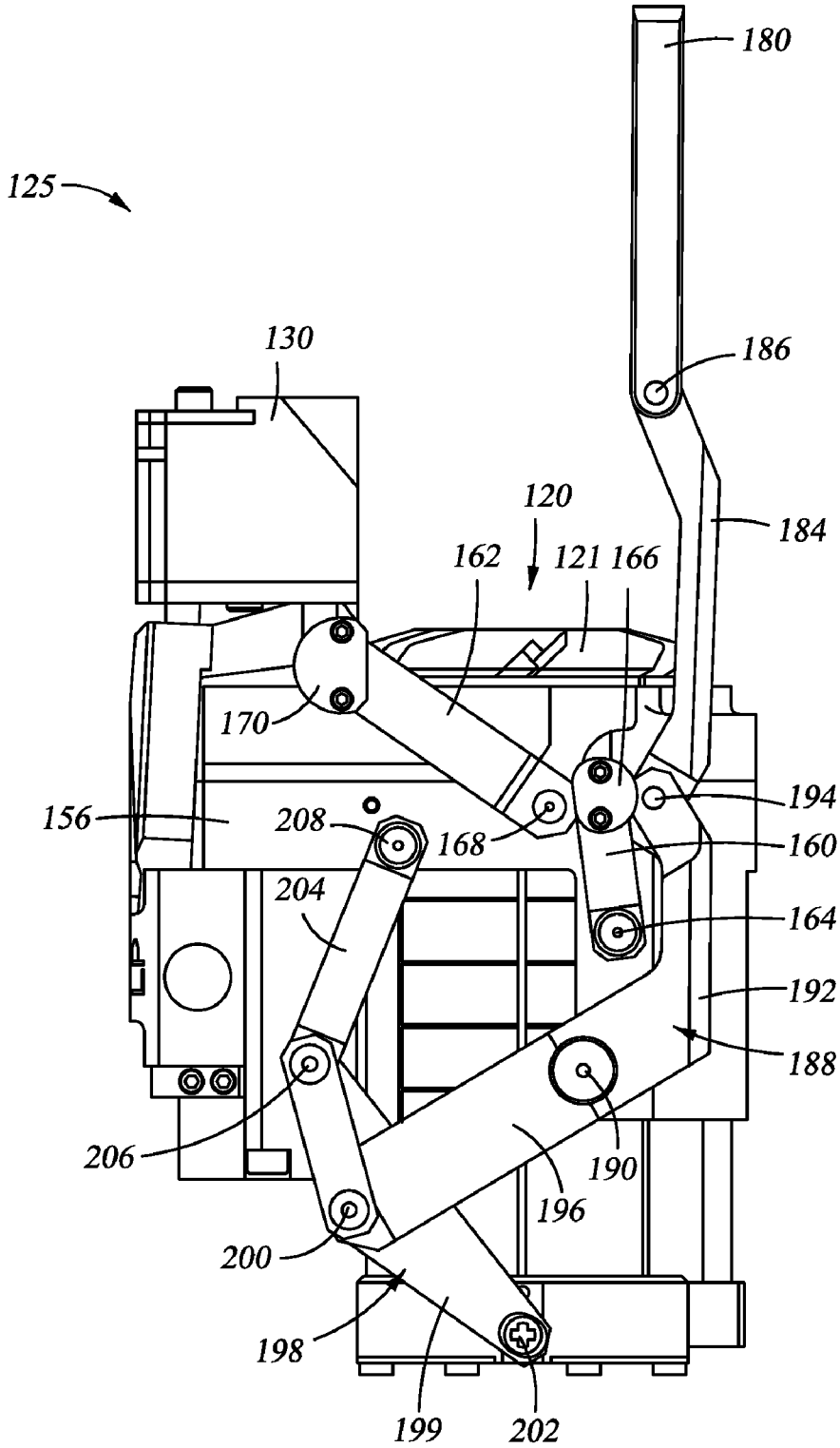
FIG. 10A is a side elevation view of a coring assembly used in the coring tool module of FIG. 4.
Figure 10B:
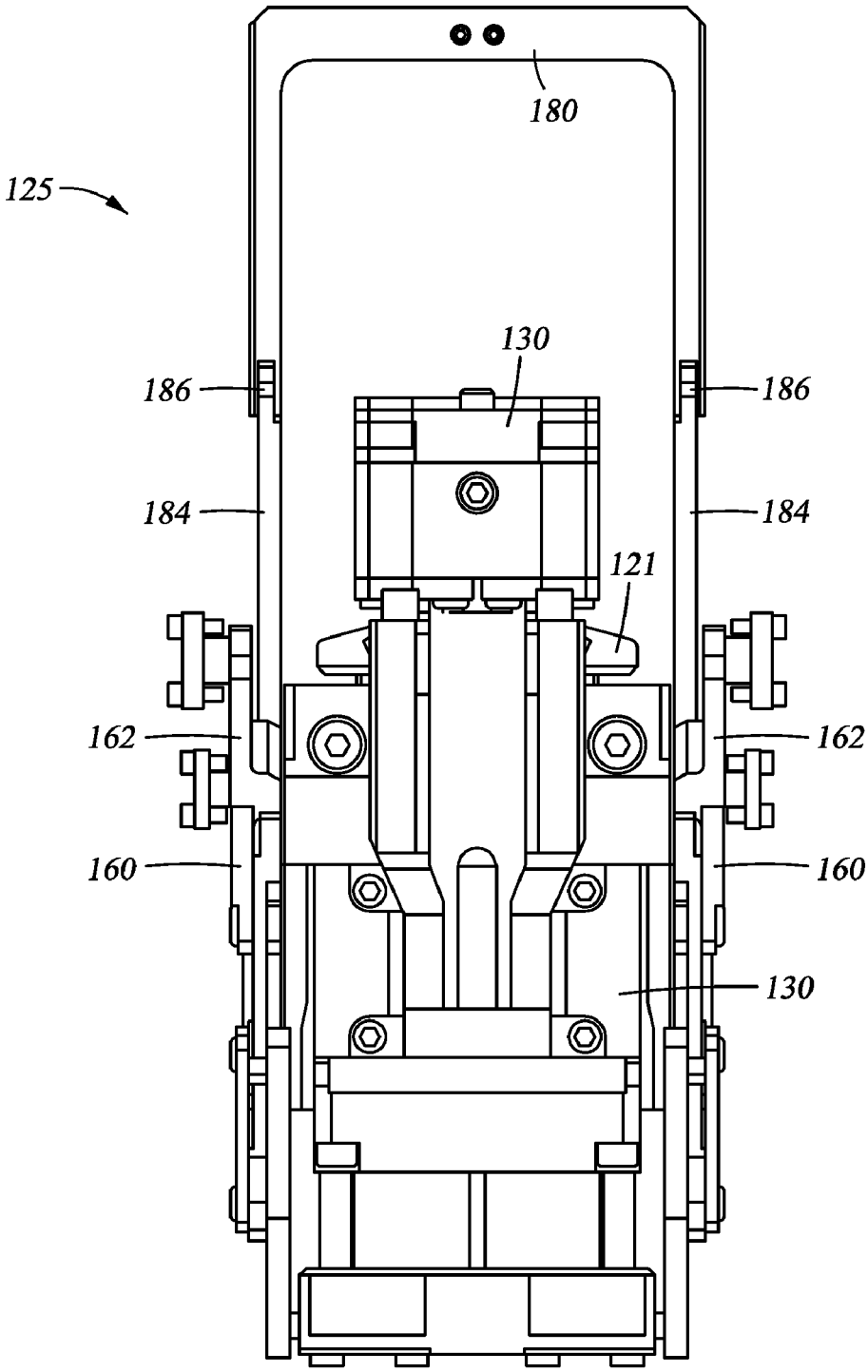
FIG. 10B is a plan view of the coring assembly shown in FIG. 10A.

One or more rotation link arms are provided for rotatably mounting the bit housing 156 with respect to the tool housing 150. As best shown in FIGS. 10A and 10B, the coring assembly 125 includes a pair of first or upper rotation link arms 160 and a pair of second or lower rotation link arms 162. Each upper rotation link arm 160 includes a first end 164 pivotably coupled to the bit housing 156 and a second end 166 pivotably coupled to the tool housing 150. Similarly, each lower rotation link arm 162 includes a first end 168 pivotably coupled to the bit housing 156 and a second end 170 pivotably coupled to the tool housing 150. As used herein, the terms "pivotably coupled" or "pivotably connected" means a connection between two tool components that allows relative rotating or pivoting movement of one of the components with respect to the other component, but does not allow sliding or translational movement of the one component with respect to the other.

Figure 6:
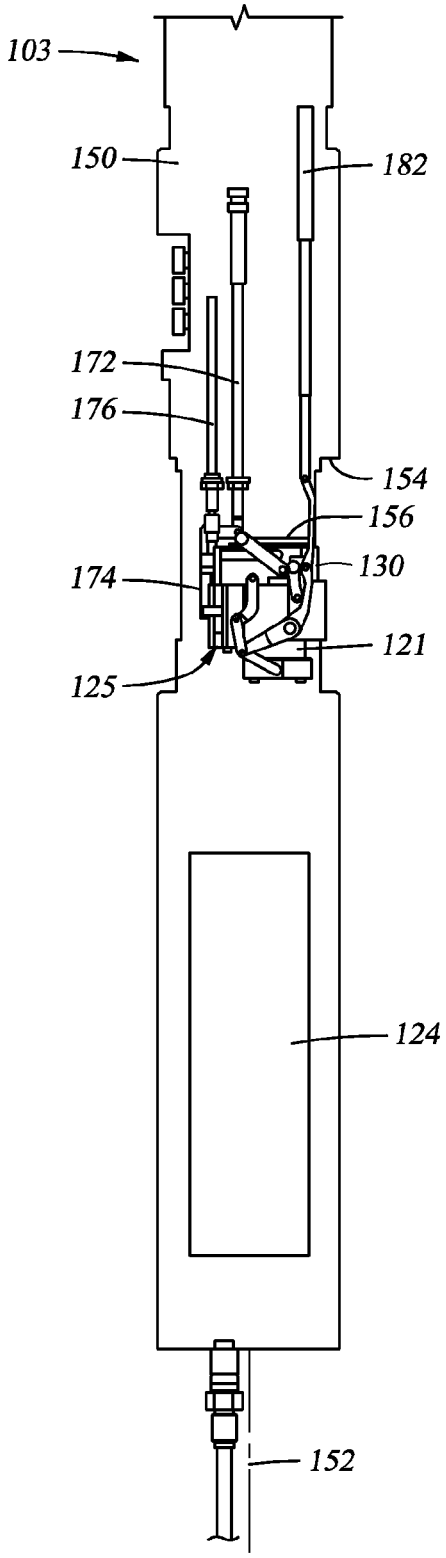
FIG. 6 is a schematic, in cross-section, of the coring tool module with a coring bit in the eject position.
Figure 7:
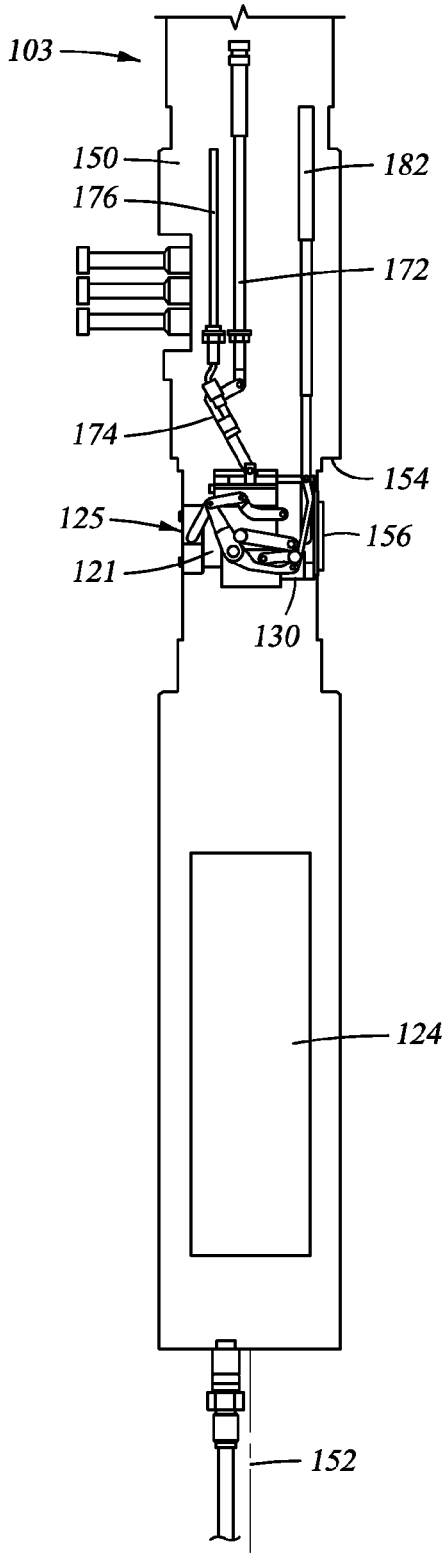
FIG. 7 is a schematic, in cross-section, of the coring tool module with the bit housing in a coring position and the coring bit retracted.

The rotation link arms 160, 162 are positioned and designed to allow the bit housing 156 to rotate with respect to the tool housing 150 from an eject position in which the coring bit 121 extends substantially parallel to the tool housing longitudinal axis 152, and a coring position in which the bit housing 156 is rotated so that they coring bit extends substantially perpendicular to the longitudinal axis 152 as illustrated in FIGS. 6 and 7, respectively. When the bit housing 156 is in the eject position, a core cavity of the coring bit 121 registers with the core receptacle 124. Conversely, when the bit housing 156 is in the coring position as shown in FIG. 6, the core cavity of the coring bit 121 registers with the coring aperture 154 formed in the tool housing 150. The term "register" is used herein to indicate that voids or spaces defined by two components (such as the core cavity of the coring bit 121 and the core receptacle 124 or coring aperture 154) are substantially aligned.

A first or rotation piston 172 is operably coupled to the bit housing 156 to rotate the bit housing 156 between the eject and coring positions. As shown in FIGS. 6-9, the rotation piston 172 is coupled to the bit housing 156 by an intermediate link arm 174. As the piston 172 moves from an extended position shown in FIG. 6 to a retracted position shown in FIG. 7, the bit housing 156 rotates about the rotation link arms 160, 162 from the eject position to the coring position. The intermediate link arm 174 may also provide convenient means for communicating hydraulic fluid from one or more hydraulic flow lines 176 to the coring motor 130.

A series of pivotably coupled extension link arms is coupled to a portion, such as the thrust ring, of the coring bit 121 to provide a substantially constant WOB. As best shown in FIGS. 10A and 10B, the series of extension link arms includes a yoke 180 adapted for coupling to a second or extension piston 182 (FIGS. 6-9). A pair of followers 184 is pivotably coupled to the yoke 180 at pins 186. A pair of rocker arms 188 is pivotably mounted on the bit housing 156 for rotation about an associated pin 190. Each rocker arm 188 includes a first segment 192 that is pivotably coupled to an associated follower link arm 184 at pin 194 and a second segment 196. A scissor jack 198 is pivotably coupled to each rocker arm. More specifically, each scissor jack 198 includes a bit arm 199 pivotably coupled to the rocker arm second segment 196 at pin 200 and further pivotably coupled to the thrust ring of the coring bit 121 at pin 202. Each scissor jack 198 further includes a housing arm 204 having a first end pivotably coupled to the bit arm 199 a pin 206 and a second end pivotably coupled to the bit housing 156 at pin 208. In the illustrated embodiment, the series of link arms includes the yoke 180, followers 184, rocker arms 188 and scissor jack 198. The series of extension link arms, however, may include additional or fewer components that are pivotably coupled to one another without departing from the scope of this disclosure and the appended claims.

Figure 8:
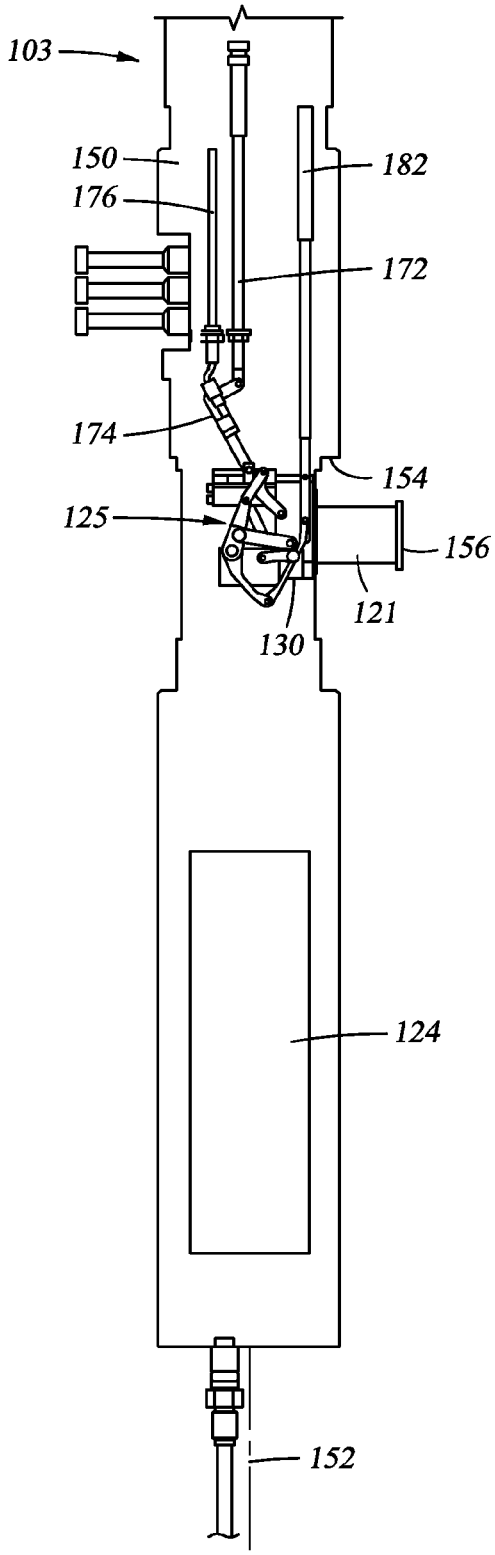
FIG. 8 is a schematic, in cross-section, of the coring tool module with the coring bit in an extended position.

With the series of extension link arms as shown, movement of the second piston 182 will actuate the coring bit 121 between a retracted position as shown in FIG. 7 and an extended position as shown in FIG. 8. The second piston 182 may begin in a retracted position as shown in FIG. 7. As the second piston 182 moves toward an extended position shown in FIG. 8, it pushes the yoke 180 and follower link arm 184 to rotate the rocker arm 188 in a clockwise direction as shown in FIG. 10A. When the rocker arm 188 rotates clockwise, it closes the scissor jack 198 thereby driving the coring bit 121 to the extended position (or toward the left as shown in FIG. 10A). By locating the pins 202, 206 as shown in FIG. 10A, the scissor jacks 198 exert a mechanical advantage as the scissor jack 198 closes. More specifically, the amount of lost motion in the series of extension link arms decreases as the scissor jacks close thereby to transfer a greater percentage of the piston force to the coring bit 121.

From the foregoing, it will further be appreciated that extension of the coring bit 121 is substantially decoupled from the rotation of the bit housing 156. The first piston 172 and intermediate link arm 174 are independent from the second piston 182 and series of extension link arms used to extend the coring bit 121. Accordingly, the first and second pistons 172, 182 may be operated substantially independent of one another, which may allow for additional functionality of the coring tool 103. For example, and notwithstanding any clearance issues with the tool housing 150 or other tool structures, the coring bit 121 may be extended at any time regardless of the position of the bit housing 156. Consequently, the coring bit may be operated at an oblique angle along a diagonal plane when the bit housing 156 is held at an orientation between the eject and coring positions described above.

Figure 9:
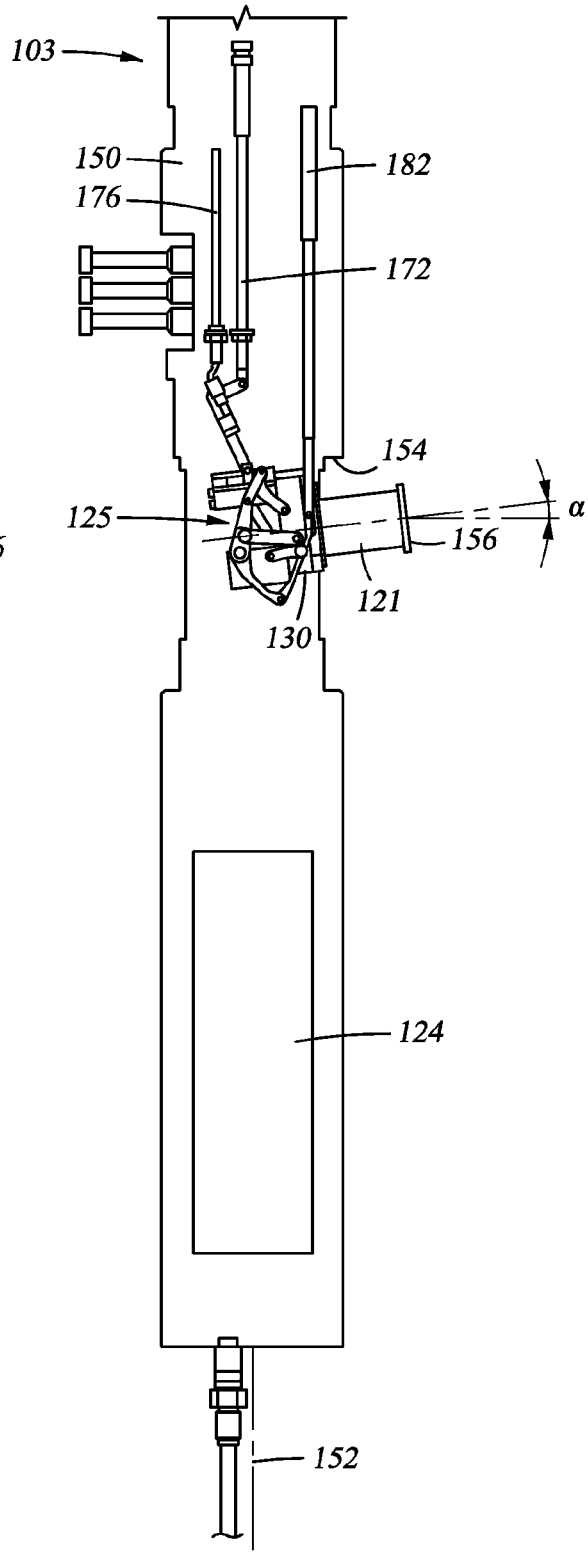
FIG. 9 is a schematic, in cross-section, of the bit housing in a sever position.

The rotation link arms 160, 162 may further permit additional rotation of the bit housing 156 to a sever position to assist with separating a core sample from the formation. When the coring bit 121 is fully extended so that cutting into the formation is complete, it is typically oriented substantially perpendicular to the longitudinal axis 152 as shown in FIG. 8. The core sample formed by the bit 121, however, may still remain securely attached to the formation. To assist with detaching the core sample, the bit housing 156 may further be rotated an additional amount to a sever position as shown in FIG. 9. It has been found that an additional angular rotation $\alpha$ of approximately 7 degrees is sufficient to sever the core sample from the formation. Often, the required additional angular rotation is less than 7 degrees, on the order of 0.25 to 2 degrees. The first and second rotation link arms 160, 162 may be advantageously positioned so that the additional rotation between the coring and severing positions occurs about a center of rotation that is substantially coincident with the distal cutting end of the coring bit 121.

Figure 11A:
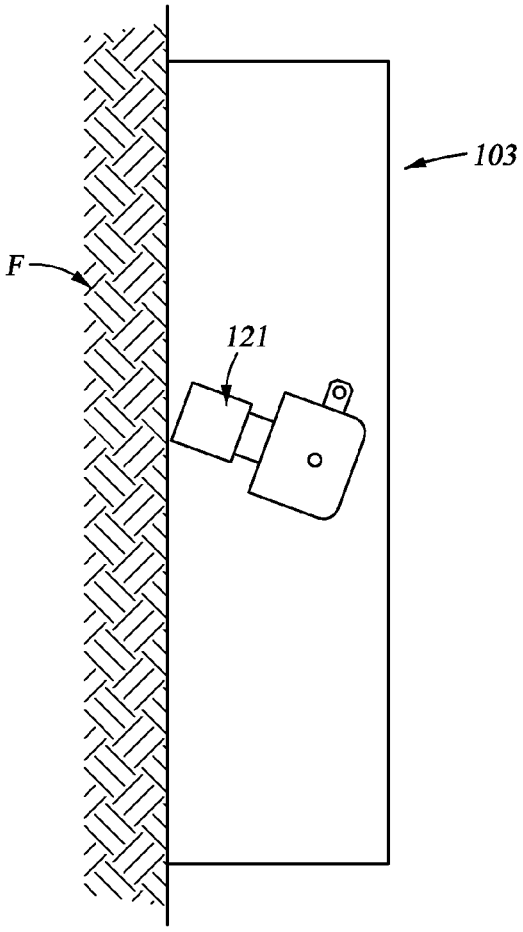
FIGS. 11A and 11B are enlarged, schematic side elevation views of the coring assembly of FIG. 4 in oblique angle and coring positions, respectively.
Figure 11B:
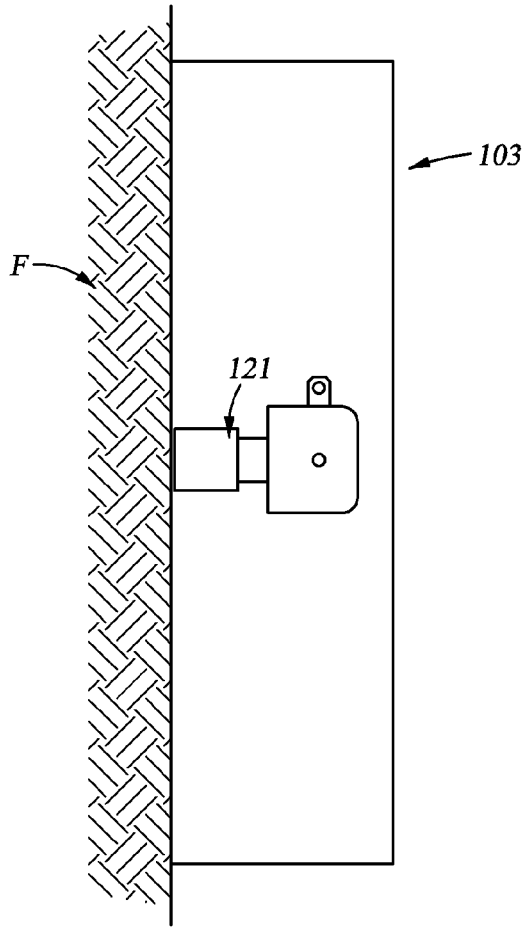
Figure 12:
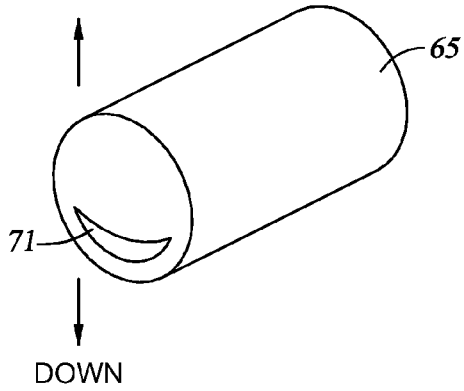
FIG. 12 is a perspective view of a sidewall core obtained using the coring assembly of FIG. 4.

The sidewall coring tool illustrated in FIGS. 4-10 may be used to form an orientation mark in the sidewall cores formed therewith. Prior to forming the core, the coring bit 121 may be operated at an angle and extended only a small distance into the formation as shown in FIG. 1 IA, to form a crescent shaped mark 71 (FIG. 12). The coring bit 121 may then be fully rotated to the coring position as shown in FIG. 11B and extended fully into the formation to form a sidewall core 73. As best illustrated in FIG. 12, the crescent shaped mark 71 inherently indicates the orientation of the core 73.

A method of forming an orientation mark in a sidewall core is also disclosed. The method includes forming a borehole in the formation, suspending a sidewall coring tool within the borehole at a selected depth, and applying a marking device to a selected location of a surface of the borehole to form the orientation mark. A coring bit is then extended into the formation at the selected location to form the sidewall core. As noted above, the marking device may be provided as a cutting blade operably coupled to the sidewall coring tool. Alternatively, the marking device may be the cutting end of the coring bit when operated at an oblique angle to form a crescent shaped orientation mark.

While the foregoing apparatus and methods are described herein in the context of a wireline tool, they are also applicable to while drilling tools. It may be desirable to take core samples using MWD or LWD tools, and therefore the methods and apparatus described above may be easily adapted for use with such tools. Certain aspects of this disclosure may also be used in different coring applications, such as in-line coring.

While only certain embodiments have been set forth, alternatives and modifications will be apparent from the above description to those skilled in the art. These and other alternatives are considered equivalents and within the spirit and scope of this disclosure and the appended claims.

What is claimed:

1. A sidewall coring tool for use in a borehole formed in a subterranean formation, comprising:

a tool housing adapted for suspension within the borehole at a selected depth and defining a longitudinal axis;

a coring assembly coupled to the tool housing, the coring assembly including a bit housing and a coring bit coupled to the bit housing, the coring bit being supported for movement between a transport position and a coring position; and a marking device located at a known position with respect to the coring bit and adapted to form an orientation mark in the formation, wherein the marking device comprises a cutting blade.

2. The sidewall coring tool of claim 1, in which the coring bit defines a coring bit axis, and in which the coring bit axis is substantially parallel to a borehole axis in the transport position and substantially perpendicular to the borehole axis in the coring position.

3. The sidewall coring tool of claim 2, in which the coring assembly includes a motor operably coupled to the coring bit, and in which the marking device is operably coupled to the coring motor to reciprocate the marking device.

4. The sidewall coring tool of claim 3, in which the marking device is offset with respect to an axis of the coring bit.

5. The sidewall coring tool of claim 1, in which the marking device is coupled to the tool housing.

6. The sidewall coring tool of claim 1, in which the coring bit is operable at an oblique angle, and in which the marking device comprises a cutting end of the coring bit when operated at the oblique angle.

7. A sidewall coring tool for use in a borehole formed in a subterranean formation, comprising:

a tool housing adapted for suspension within the borehole at a selected depth and defining a longitudinal axis;

a coring assembly coupled to the tool housing, the coring assembly including a bit housing, a motor, and a coring bit disposed in the bit housing and operably coupled to the motor to move between transport and coring positions; and a marking device supported for reciprocating movement with respect to the tool housing and operably coupled to the coring assembly motor, wherein the marking device is offset with respect to an axis of the coring bit.

8. The sidewall coring tool of claim 7, in which the marking device comprises a cutting blade.

9. The sidewall coring tool of claim 7, in which the coring bit defines a coring bit axis, and in which the coring bit axis is substantially parallel to a borehole axis in the transport position and substantially perpendicular to the borehole axis in the coring position.

10. A sidewall coring tool for use in a borehole formed in a subterranean formation, comprising:

a tool housing adapted for suspension within the borehole at a selected depth and defining a longitudinal tool axis;

a coring aperture formed in the tool housing;

a core receptacle disposed in the tool housing;

a bit housing disposed within the tool housing;

a coring bit mounted within the bit housing, the coring bit including a cutting end and defining a coring bit axis;

a bit motor operably coupled to the coring bit and adapted to rotate the coring bit around the bit axis;

a rotation actuator operably coupled to the bit housing and adapted to actuate the bit housing between an eject position, in which the coring bit axis is substantially parallel to the tool axis, and a coring position, in which the coring bit axis is substantially perpendicular to the tool axis;

an extension actuator operably coupled to the coring bit and adapted to move the coring bit between retracted and extended positions, wherein the extension actuator is operable independent of the rotation actuator to extend the coring bit when the coring bit axis is at an oblique angle, thereby to form an orientation mark in the formation.

11. A method of marking a core retrieved from a sidewall of a wellbore penetrating a subterranean formation, comprising:

suspending a sidewall coring tool within a borehole at a selected depth;

marking a surface of the borehole at a selected location with a marking device to form an orientation mark; and extending a coring bit into the formation at the selected location to form a sidewall core, wherein the marking device is offset with respect to an axis of the coring bit.

12. The method of claim 11, in which the marking device comprises a cutting blade operably coupled to the sidewall coring tool.

13. The method of claim 12, in which the coring bit is operably coupled to a bit drive for rotation between a transport position and a coring position, and in which the cutting blade is also operably coupled to the bit drive.

14. The method of claim 11, in which the coring bit includes a cutting end, and in which the marking device comprises the coring bit cutting end.

15. The method of claim 14, in which the coring bit is operated at an oblique angle and extended only partially into the formation to form the orientation mark.

* * * * *